US009239187B2

(12) United States Patent
Pepitone et al.

(10) Patent No.: US 9,239,187 B2
(45) Date of Patent: Jan. 19, 2016

(54) PROCESS FOR EXTRACTION OF WATER FROM MUNICIPAL SOLID WASTE, CONSTRUCTION AND DEMOLITION DEBRIS, AND PUTRESCIBLE WASTE

(71) Applicants: Jason Pepitone, Lighthouse Point, FL (US); Joseph Michel, Deerfield Beach, FL (US); Morgan Pepitone, Deerfield Beach, FL (US)

(72) Inventors: Jason Pepitone, Lighthouse Point, FL (US); Joseph Michel, Deerfield Beach, FL (US); Morgan Pepitone, Deerfield Beach, FL (US)

( * ) Notice: Subject to any disclaimer, the term of this patent is extended or adjusted under 35 U.S.C. 154(b) by 130 days.

(21) Appl. No.: 13/946,248

(22) Filed: Jul. 19, 2013

(65) Prior Publication Data

US 2014/0068963 A1 Mar. 13, 2014

Related U.S. Application Data

(60) Provisional application No. 61/673,287, filed on Jul. 19, 2012, provisional application No. 61/813,293, filed on Apr. 18, 2013.

(51) Int. Cl.
*F26B 3/24* (2006.01)
*F26B 17/20* (2006.01)

(52) U.S. Cl.
CPC . *F26B 3/24* (2013.01); *F26B 17/20* (2013.01); *F26B 17/205* (2013.01)

(58) Field of Classification Search
CPC ..... F26B 3/00; F26B 3/24; F26B 17/00; F26B 17/20; F26B 19/00; F26B 21/00; C10G 1/00; C10G 11/00; C10G 65/00; C10G 65/02
USPC ..... 34/282, 519, 521; 208/49, 108
See application file for complete search history.

(56) References Cited

U.S. PATENT DOCUMENTS

| | | | | | |
|---|---|---|---|---|---|
| 4,245,396 | A * | 1/1981 | Maffet | 34/386 |
| 4,750,274 | A * | 6/1988 | Erdman et al. | 34/520 |
| 4,829,678 | A * | 5/1989 | Glorioso | 34/378 |
| 5,375,344 | A * | 12/1994 | Ruefli et al. | 34/269 |
| 5,765,293 | A * | 6/1998 | St. Louis et al. | 34/305 |
| 5,873,945 | A * | 2/1999 | Patzelt et al. | 134/12 |
| 6,006,442 | A * | 12/1999 | Banerjee et al. | 34/398 |
| 6,226,889 | B1 * | 5/2001 | Aulbaugh et al. | 34/424 |
| 6,688,318 | B1 * | 2/2004 | Clark | 134/107 |
| 6,769,836 | B2 * | 8/2004 | Lloyd | 404/75 |
| 7,024,800 | B2 * | 4/2006 | Gorbell et al. | 34/576 |

(Continued)

FOREIGN PATENT DOCUMENTS

| | | | | |
|---|---|---|---|---|
| DE | 102007030927 | A1 * | 1/2009 | C05F 17/00 |
| JP | 2002066599 | A * | 3/2002 | C02F 11/12 |

*Primary Examiner* — Stephen M Gravini
(74) *Attorney, Agent, or Firm* — Robert M. Downey, P.A.

(57) ABSTRACT

A process for reducing the cost associated with the transportation and disposal of waste material by extracting water ad other liquids from municipal solid waste, construction and demolition debris, and putrescible waste to thereby significantly reduce the weight of the material prior to transport. In one embodiment, the process involves waste product being turned through a heated auger system, wherein the waste material is indirectly heated by high temperature oil to remove the liquid (including water) and moisture content from the waste product. In another embodiment, the process involves manual or automated movement of the waste material through an environmentally contained area that houses heating devices (e.g., heat lamps) for simulating sunlight, fans, and a water purification and filtration system for drying the waste material and delivering the water content to the water filtration and purification system.

6 Claims, 3 Drawing Sheets

(56) References Cited

U.S. PATENT DOCUMENTS

| | | | | |
|---|---|---|---|---|
| 7,310,892 | B1 * | 12/2007 | Cate et al. | 34/408 |
| 7,574,816 | B2 * | 8/2009 | Shivvers | 34/333 |
| 7,610,692 | B2 * | 11/2009 | Carin et al. | 34/388 |
| 7,669,349 | B1 * | 3/2010 | Palmer et al. | 34/381 |
| 7,879,379 | B1 * | 2/2011 | Widmer et al. | 426/481 |
| 7,987,613 | B2 * | 8/2011 | Ness et al. | 34/138 |
| 8,196,311 | B2 * | 6/2012 | O'Reilly | 34/386 |
| 8,215,028 | B2 * | 7/2012 | Eia | 34/60 |
| 8,220,178 | B2 * | 7/2012 | Schellstede | 34/247 |
| 8,407,912 | B2 * | 4/2013 | Hubbard et al. | 34/82 |
| 8,499,471 | B2 * | 8/2013 | Coronella et al. | 34/381 |
| 8,832,964 | B2 * | 9/2014 | Foxen | 34/396 |
| 2006/0101665 | A1 * | 5/2006 | Carin et al. | 34/513 |
| 2008/0022587 | A1 * | 1/2008 | Macchio | 44/605 |
| 2008/0271335 | A1 * | 11/2008 | Kimball | 34/79 |
| 2010/0108567 | A1 * | 5/2010 | Medoff | 208/49 |
| 2010/0307021 | A1 * | 12/2010 | Wills | 34/342 |
| 2014/0068963 | A1 * | 3/2014 | Pepitone et al. | 34/521 |

* cited by examiner

PROCESS FOR EXTRACTION OF WATER FROM MUNICIPAL SOLID WASTE, CONSTRUCTION AND DEMOLITION DEBRIS, AND PUTRESCIBLE WASTE

BACKGROUND OF THE INVENTION

This patent application is based on provisional patent application Ser. No. 61/673,287 filed Jul. 19, 2012 and provisional patent application Ser. No. 61/813,293 filed Apr. 18, 2013.

FIELD OF THE INVENTION

The present invention relates to improvement of the efficiency of waste management and, more particularly, a process for extracting water from waste material prior to transportation and disposal of the waste material into a landfill, and wherein the extracted water can be filtered and/or purified for use either onsite or for offsite purposes (e.g., reclaimed water for irrigation in a municipality).

DISCUSSION OF THE RELATED ART

The composition of waste material, including municipal solid waste (MSW), construction and demolition debris (C & D), and putrescible waste, typically includes a considerable amount of water and moisture, which significantly increases both by the weight and volume of the waste material composition. The expenses associated with transporting waste material and disposing waste material in a landfill are directly related to the weight and volume of the waste material. Therefore, there is a particular need for a process for extraction of water from all kinds of waste material in order to reduce the expenses associated with transportation and disposal of the waste material in a landfill.

SUMMARY OF THE INVENTION

The present invention is directed to a process for reducing the cost associated with the transportation and disposal of waste material by extracting water from municipal solid waste (MSW), construction and demolition debris (C & D), and putrescible waste and thereby significantly reducing the weight of the material prior to transport. In one embodiment of the invention, the process involves waste product being turned through a heated auger system, wherein the waste is indirectly heated by high temperature oil that circulates through interior walls of the auger system. The waste material is heated to a temperature that is sufficient to remove the water and moisture content from the waste product. More particularly, an oil heater system includes an expansion tank for storing oil, a coil-type tube heater and a fuel burner (e.g. diesel fuel burner) for heating the oil and a pump for pumping the heated oil through the jacketed auger system before returning the heated oil back to the expansion tank. The auger system has mixing paddles that turn the waste material to expose all surfaces of the waste to the heated perimeter. The waste water extracted from the waste material is transformed into a vapor that is directly released into the air via open top augers.

In another embodiment of the invention, the process involves manual or automated movement of the waste material through an environmentally contained area that houses heating devices (e.g., high intensity lights), fans, and a water purification and filtration system. In one embodiment, the waste material is transported via a conveyor belt having a grated surface to allow for aeration of the waste material. In operation, as the waste material is transported through the environmentally contained area, the fans and heating devices dry the waste material as the moisture and water content evaporates from the waste material and enters the water filtration and purification system. The water and moisture content is filtered before entering the plumbing system and being deposited in a water holding tank. Thereafter, the waste water can be used for any onsite purposes or, conversely, sold to municipalities or other offsite entities (e.g., for landscape or farming irrigation).

Objects and Advantages of the Invention

Considering the foregoing, it is a primary object of the present invention to provide a process for reducing the cost associated with transportation and disposal of waste material by extracting liquid and moisture from waste material prior to transport.

It is a further object of the present invention to provide a process for extracting water and other liquid and moisture from waste material in a systematic and cost efficient manner.

It is a further object of the present invention to provide a process for extracting water from waste material and wherein the extracted water is filtered and/or purified for subsequent use.

These and other objects and advantages of the present invention are readily apparent with reference to the detailed description and accompanying drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF INVENTION

Referring to the several views of the drawings, the process for reducing the cost associated with transportation and disposal of waste material WM, including municipal solid waste (MSW), construction and demolition debris (C & D), and putrescible waste, by extracting water from waste material WM prior to transport, is shown and generally indicated as 10.

Figure 1:
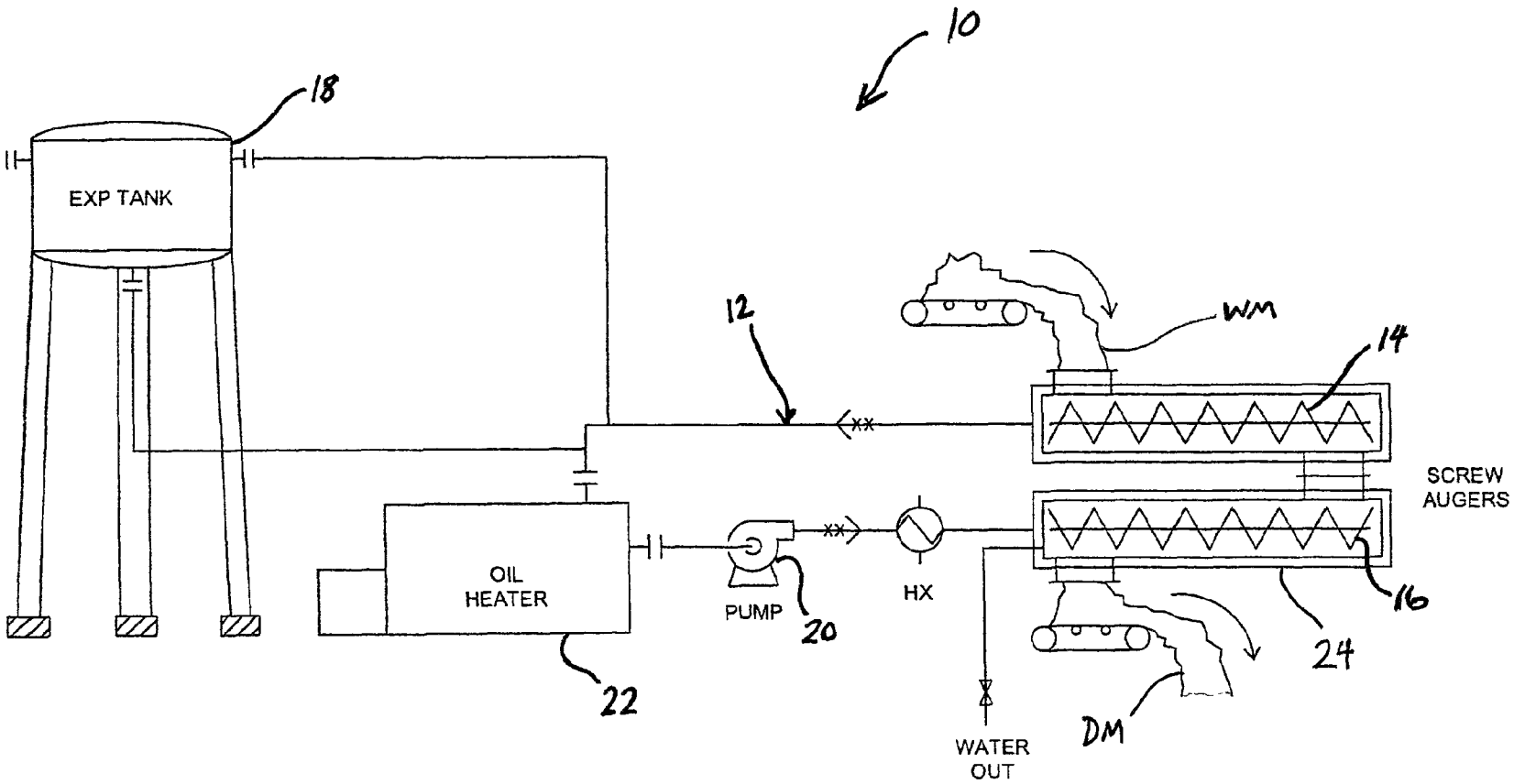
FIG. 1 is a side view illustrating a schematic diagram of the process for reducing the cost associated with transportation and disposal of waste material by extracting water from waste material prior to transport, according to one embodiment of the invention.

The waste water removal process 10 requires manual or automated movement of the waste material WM through an environmentally contained area 12. Indirect heat is used to vaporize the water content of the waste material WM. In a preferred embodiment, heated oil is directed through interior channels within the wall structure of a cylindrical screw auger housing, causing the inner wall surfaces of the screw augers to become hot. Referring to FIG. 1, the waste material WM is then delivered (via conveyor belt) into a first level screw auger 14, wherein mixing paddles force the waste material WM to be constantly tossed and turned over, thereby exposing all surfaces of the waste material WM to the hot walls of the screw auger during the water extraction process. In one embodiment, the waste material WM is automatically transferred into a second level screw auger 16 for additional water extraction.

As further illustrated in FIG. 1, an expansion tank 18 stores oil which is pumped by pump 20 into oil heater 22 (e.g. diesel fuel burner) in order to heat the oil. The pump 20 subsequently pumps the heated oil into a perimeter shell 24 lining first level and second level screw augers 14 and 16 to heat the inner wall surfaces of the screw augers 14 and 16. This causes the waste material WM to become heated (to the point of vaporization) as it is tossed and turned over by the screw augers 14 and 16. In the embodiment shown in FIG. 1, the dry waste material WM exits the auger system and the water is transformed into a vapor that is directly released into the air via open top augers. The pump 20 returns the heated oil back to the expansion tank 18.

An example of the process for extraction of water from 50 tons of waste material being comprised by approximately 30 percent by weight of water is provided below:

| |
|---|
| 50 tons of waste per hour (TPH) |
| 30.0% $H_2O$ |
| 30,000 lb $H_2O$/hr |
| 70,000 lb municipal solid waste (MSW)/hr |
| 0.9 MSW Specific Heat |
| 1.0 H2O Specific Heat |
| 70° F. Ambient Temperature |
| 1,400 BTU/lb Latent Heat of Vaporization Water |
| 8,946,000 BTUs required for heating MSW |
| 4,260,000 BTUs required for heating $H_2O$ |
| 42,000,000 BTUs required for vaporizing the $H_2O$ |
| 55,206,000 Total BTUs required for water extraction |
| 55.21 MMBTU/hr |

The above example is for extraction of water from 50 tons of waste material WM per hour. Approximately 30% of the waste material WM is water, which equates to 30,000 lb $H_2O$/hr and 70,000 lb MSW/hr. While 970 BTU/lb is sufficient to vaporize water under ideal circumstances, 1,400 BTU/lb is used in this example. Approximately 8,946,000 BTUs are required for heating the MSW; 4,260,000 BTUs are required for heating the water; and 42,000,000 BTUs are required for vaporizing the water. Therefore, approximately 55.21 MMBTU/hr is required to vaporize extracted water from 50 tons of waste material WM being introduced to the system per hour.

After going through the waste water removal process 10, waste material WM will be reduced in volumetric size and weight into dry material DM, and can be further compacted if required. Moreover, the expenses associated with transporting and disposing of such dry material DM will be less due to the volumetric size and weight of the original waste material WM having been significantly reduced.

Figure 2:
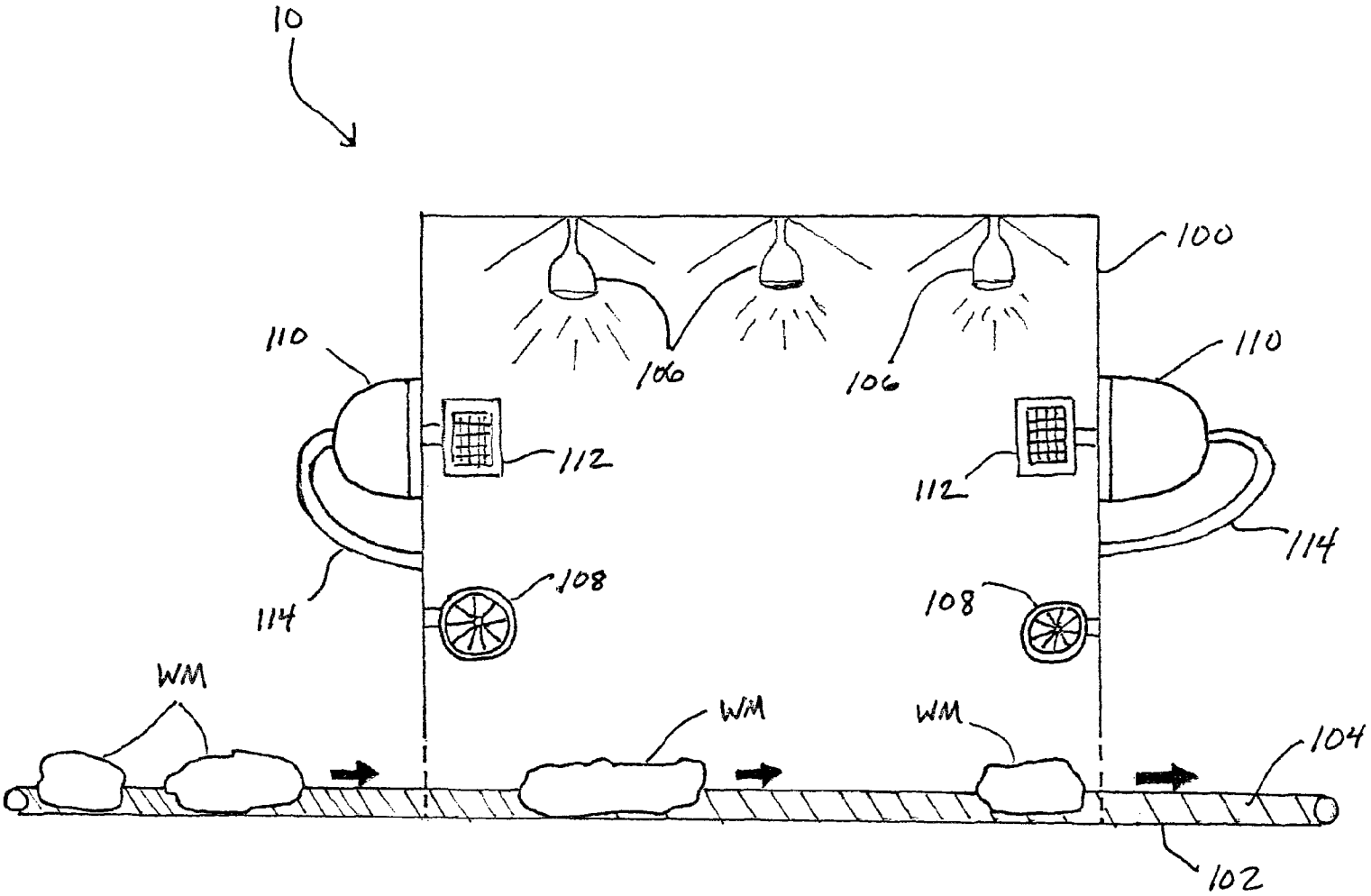
FIG. 2 is a side elevational view illustrating a further embodiment of the process for reducing the cost associated with transportation and disposal of waste material by extracting water from waste material prior to transport and showing the interior of an environmentally contained area.
Figure 3:
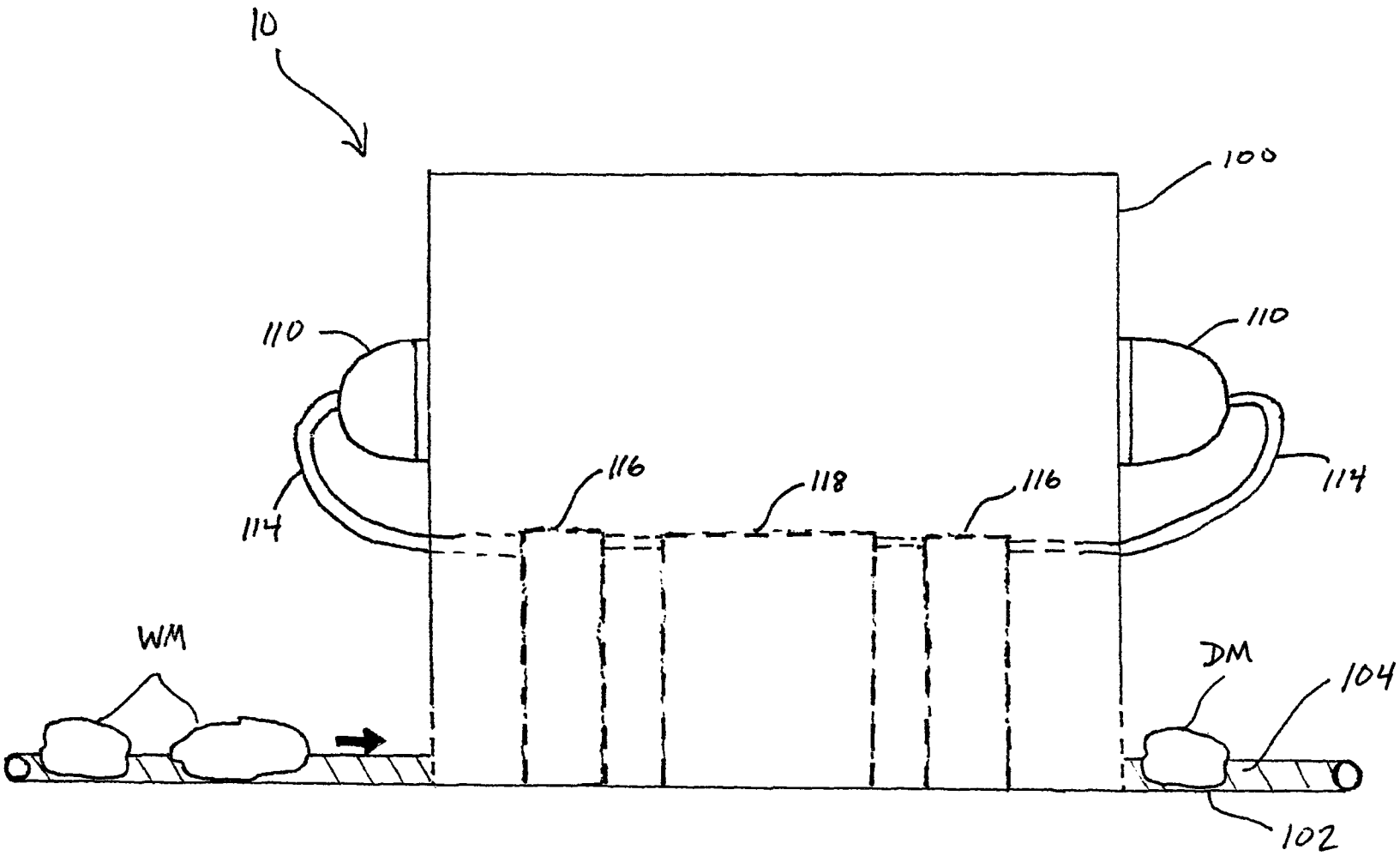
FIG. 3 is a side elevational view illustrating the further embodiment shown in FIG. 2 of the process for reducing the cost associated with transportation and disposal of waste material by extracting water from waste material prior to transport and showing the exterior of the environmentally contained area.

Referring to FIGS. 2 and 3, a further embodiment of the process 10 for reducing the cost associated with transportation and disposal of waste material WM by extracting water from waste material WM prior to transport involves manual or automated movement of the waste material WM through an environmentally contained area 100. As shown in FIGS. 2 and 3, the waste material WM may be transferred through the environmentally contained area 100 via a conveyor belt 102 having a grated top surface 104 for aerating the waste material WM. Included in the environmentally contained area 100 are a plurality of simulated sunlight devices or heat lamps 106 and a plurality of fans 108 for drying the waste material WM being transported via conveyor belt 102.

Water extraction systems 110 having a filter 112 are provided for removing the moisture, water and other liquid content from the waste material WM and transporting the waste water and liquid into a plumbing system 114, which is in communication with a purification testing tank 116. In one embodiment, the water extraction systems 110 include a pump for pumping the waste water through the system 110. After being tested for purity, the waste water is transferred to a water holding tank 118 and may thereafter be used for a number of useful purposes onsite, such as dust control and irrigation, as well as being sold offsite to a municipality or other entity.

After going through the waste water removal process 10, waste material WM will be reduced in volumetric size and weight into dry material DM, and can be further compacted if required. Moreover, the expenses associated with transporting and disposing of such dry material DM will be significantly less due to the volumetric size and weight of the original waste material WM having been reduced.

While the present invention has been shown and described in accordance with several preferred and practical embodiments, it is recognized that departures from the instant disclosure are contemplated within the spirit and scope of the present invention which are not to be limited except as defined in the following claims as interpreted under the Doctrine of Equivalents.

What is claimed is:

1. A method for reducing the cost of transportation and disposal of waste material comprising the steps of:

gathering waste material at a processing site;

moving the gathered waste material along a linear path while simultaneously exposing the gathered waste material to surrounding air within a contained environment;

exposing the gathered waste material to heat while the gathered waste material is moved along the linear path and causing liquid and moisture to be removed from the gathered waste material by evaporation;

releasing the evaporation of the liquid and moisture into the surrounding air in the contained environment to yield a dry waste material that is lighter in volumetric weight than the gathered waste material; and collecting the dry waste material for transport to a disposal facility.

2. The method as recited in claim 1 further comprising:

providing at least one screw auger for moving the gathered waste material along the linear path, and the at least one screw auger having an arrangement of rotatable paddles surrounded by a wall structure having an inner wall surface and interior channels adjacent to the inner wall surface;

heating a charge of oil;

pumping the heated oil through the interior channels of the wall structure and heating the inner wall surface; and passing the gathered waste material through the screw auger and turning the waste material with the rotatable paddles to expose the waste material to the heated inner wall surface and thereby heating the waste material to cause evaporation of the liquid and moisture from the waste material; and allowing the evaporated liquid and moisture to be released into the surrounding air in the contained environment.

3. The method as recited in claim 1 further comprising:

providing at least one conveyor belt for moving the gathered waste material along the linear path while simultaneously exposing the gathered waste material to the surrounding air in the contained environment.

4. The method as recited in claim 3 wherein the step of exposing the gathered waste material to heat further comprises:

directing radiant heat onto the gathered waste material as the gathered waste material is being moved along the linear path on the conveyor belt.

5. The method as recited in claim 4 further comprising the step of:

directing a flow of air from at least one fan onto the gathered waste material as the gathered waste material is being moved along the linear path on the conveyor belt.

6. The method as recited in claim 5 wherein the conveyer belt comprises a grated top surface for aerating the gathered waste material as the gathered waste material is moved along the linear path on the conveyor belt.

* * * * *